United States Patent [19]

Mims et al.

[11] Patent Number: 4,819,725

[45] Date of Patent: Apr. 11, 1989

[54] RECOVERING OIL BYPASSED BY A STEAM OVERRIDE ZONE

[75] Inventors: Donald S. Mims; Donald L. Hoyt, both of Houston, Tex.

[73] Assignee: Texaco Inc., White Plains, N.Y.

[21] Appl. No.: 137,991

[22] Filed: Dec. 28, 1987

[51] Int. Cl.[4] ..... E21B 43/24

[52] U.S. Cl. ..... 166/271; 166/272; 166/303

[58] Field of Search ..... 166/263, 271, 272, 273, 166/274, 303; 299/2

[56] References Cited

U.S. PATENT DOCUMENTS

| | | | |
|---|---|---|---|
| 1,884,858 | 10/1932 | Ranney | 299/2 X |
| 3,908,762 | 9/1975 | Redford | 166/271 X |
| 4,386,658 | 6/1983 | Hunt, III | 166/272 X |
| 4,733,726 | 3/1988 | Alameddine et al. | 166/271 X |

*Primary Examiner*—William P. Neuder

*Attorney, Agent, or Firm*—Jack H. Park; Kenneth R. Priem; Harold J. Delhommer

[57] ABSTRACT

The invention is a method of recovering oil bypassed by a steam override zone. First, the production well is drilled below the oil producing zone into an underlying interval. The well perforations in the oil producing zone are closed off. The underlying interval is fractured to establish fluid communication between the underlying interval and the oil producing zone. The production well is completed for production through the fractured portion of the underlying interval. Finally, the steamflood is controlled to increase the pressure in the oil producing zone and drive the oil and steam downward to the new perforations in the underlying for production.

7 Claims, No Drawings

RECOVERING OIL BYPASSED BY A STEAM OVERRIDE ZONE

BACKGROUND OF THE INVENTION

The invention concerns a method to recover a portion of oil bypassed by a steam override zone during a steamflood by recompleting a production well into the interval underlying the oil producing zone.

It is well recognized that primary hydrocarbon recovery techniques recover only a portion of the petroleum in the formation. Thus, numerous secondary and tertiary recovery techniques have been suggested and employed to increase the recovery of hydrocarbons from the formations holding them in place. Thermal recovery techniques have proven to be effective in increasing the amount of oil recovered from the ground, particularly for heavy oils. Steamflooding has been the most successful thermal recovery technique yet employed in commercial practice. However, steamflooding may still leave up to 60% to 70% of the original hydrocarbons in place, depending on the formation and the quality of oil.

When an oil reservoir is subjected to steam injection, steam tends to move up in the formation, and condensate and oil tend to move down due to the density difference between the fluids. Gradually, a steam override condition develops, in which the injected steam sweeps the upper portion of the oil zone, but leaves the lower portion untouched. Injected steam will tend to follow the path of least resistance from an injection well to a production well. Thus, areas of high permeability will receive more and more of the injected steam which further raises the permeability of such areas. This phenomenon exists to an even larger degree with low injection rates and thick formations. The steam override problem worsens at greater radial distances from the injection well because steam flux decreases with an increase in steam zone radius.

Although residual oil saturation in the steam swept region can be as low as 10%, the average residual oil saturation in the formation remains much higher due to poor vertical conformance. For these reasons, increasing vertical conformance in steamfloods by reducing the amount of oil bypassed by a steam override zone has long been a concern of the oil industry.

SUMMARY OF THE INVENTION

The invention is a method of recovering oil bypassed by a steam override zone during a steamflood which comprises a multi-step method of recompleting a production well in the interval underlying the oil producing zone, and altering the steamflood to drive oil and steam downward through a new path to the production well. First, the production well is drilled below the oil producing zone into an underlying interval. The well perforations in the oil producing zone are closed off to prevent oil and steam from entering the production well from the oil producing zone. The underlying interval is then fractured to establish fluid communication between the underlying interval and the oil producing zone. The production well is completed for production through the fractured portion of the underlying interval. Finally, the steamflood is controlled to increase the pressure in the oil producing zoe and drive the oil and steam downward through the fractures to the new perforations in the underlying interval. Hydrocarbons and other fluids are then recovered through the production well.

DETAILED DESCRIPTION

Oil production is improved by the use of the invention method in a steamflood. A greater volume of oil is recovered because of two main factors. First, the path of the steam override zone is changed to channel through oil previously bypassed to reach the new location of the production well. Second, the method of recovery is changed from a horizontal drive to a vertical drive which is much more efficient for displacing fluids of significantly different densities, such as steam displacing oil.

The method is first practiced by drilling a production well below the oil producing zone into an underlying interval. The well perforations in the oil producing zone are closed off to prevent oil and steam from entering the production well from the oil producing zone. The underlying interval is fractured in a way well known to those skilled in the art to establish fluid communication between the underlying interval and the oil producing zone. The production well is then completed for production through the fractured portion of the underlying interval.

The steamflood is controlled to increase the pressure in the oil producing zone to drive the oil and steam downward to the new perforations in the underlying interval. It will normally be necessary to increase the steam injection rate to accomplish this goal. However, other steps may be taken to drive the oil and steam downward to the underlying interval. Such steps include controlling production rates, shutting in of selected production wells, altering steam flow paths through other methods such as the use of steam foaming agents, and other methods known to those skilled in the art.

By increasing the pressure in the oil and steam zone to drive the oil downward, displacement is accomplished chiefly by a dynamic pressure gradient instead of buoyant forces. Thus, the oil can be made to move downward to the lower perforations even against a high water saturation in the underlying interval. If the lower zone is gas filled, then the replacement of gas by oil will also be affected by buoyant forces along with displacement by the dynamic pressure gradient. By closing the original perforations where steam was being lost and continuing steam injection, the dynamic pressure gradient in the steam zone increases. This changes the method of recovery from a horizontal drive to a more efficient vertical drive, at least in the proximity of the production well.

The location and angle of fractures to the upper oil producing zone cannot be completely controlled. Fractures will vary depending on the method of fracturing employed, and geology factors such as the kind of rock, rock orientation and method of deposition. It is desirable to fracture with a maximum angle of 45° with the interface between the oil producing zone and the underlying interval and have the fracture extend a substantial distance away from the production well, preferably up to half the distance to the injection well. Such a fracture location will pull steam down to sweep through the middle of the oil bypassed by the steam override zone.

The new perforations in the underlying interval are preferably made about 10 feet to about 50 feet below the oil producing zone. A minimum of 10 feet is necessary to prevent the new completion from pulling steam down from around the closed perforations if the steam phase has already reached the base of the oil zone. Such a coning down of steam immediately around the production well will defeat the purpose of the invention in that instance. Otherwise, the distance at which to begin new perforations below the oil zone will depend upon the individual case. For example, in numerical simulation studies, the invention method with new perforations 10 to 50 feet below the oil producing zone recovered more oil than new perforations made from 0 to 50 feet below the oil zone. However, both of these cases produced more oil than a base case without the invention method and a standard completion throughout the oil producing zone.

The 50 foot guideline is quite arbitrary and could be changed depending on many factors, such as well spacing, type of rock, and rock orientation. Assuming a maximum 45° fracture angle, a close well spacing of 165 feet, and fractures extending about one-third of the distance between the injection and production wells, the new perforations should probably be no more than 50 feet below the upper zone.

An additional improvement can be achieved by performing a standard steam stimulation in the newly perforated zone. This additional influx of thermal energy will preferentially move through the fractures toward the oil zone, and provide a reservoir of heat that will reduce the viscosity of the approaching oil. Response time will be shortened and oil flow increased by this procedure.

The production well is completed in the underlying interval by the use of any of several methods well known in the art. Most production wells employed in steamfloods are completed with a gravel pack, slotted liner and a pump placed at the bottom of the production well to aid in production. Preferably, the production well will be completed with an underreamed gravel pack and slotted liner extending through the fractured portion of the underlying interval and the bottom one-half of the oil producing zone.

Certain reservoir conditions may decrease the oil recovery benefit obtained by the instant invention. A high water saturation in the underlying interval may make it more difficult for the oil and steam to be driven downward to the new perforation interval in the the underlying interval. Water or gas in the underlying interval may tend to dominate initial production from the newly completed well. Such a problem may be diminished by the use of increased pressure in the steam and oil zone to drive the fluids down through the fracture into the underlying interval and into the newly completed production well.

A relatively high permeability in the underlying interval will also decrease or perhaps eliminate the added recovery that may be obtained with the invention method. In such a case, the oil from the oil producing zone must first saturate the portion of the underlying interval down to the perforations to at least a residual oil saturation to steam before any oil can be produced from the perforations in the underlying interval.

As a result, it is preferable to have an underlying interval having a relatively low permeability, most preferably a permeability of about 0 md to about 50 md. With low permeability, it is only be necessary to saturate the fracture flow channels. The loss in oil production due to the trapping of oil in and around the fractured channels will not be sufficient to prevent a successful application of the invention method. An example of an oil producing zone having an underlying interval with a relatively low permeability is the Aurignac zone of the San Ardo Field in Central California. Granite underlies a large portion of the Aurignac zone.

Many other variations and modifications may be made in the concepts described above by those skilled in the art without departing from the concepts of the present invention. For example, the distance drilled into the underlying interval, the portion of the well completed, and the size of the fracturing job can all be varied within the scope of the invention. Different types of wells including vertical wells, horizontal wells or slanted wells, may all be employed in the invention method. Accordingly, it should be clearly understood that the concepts disclosed in the description are illustrative only and are not intended as limitations on the scope of the invention.

What is claimed is:

1. A method of recovering oil from an existing production well bypassed by a steam override zone during a steamflood which comprises:

drilling a production well below the oil producing zone into an underlying interval;

closing off the well perforations in the oil producing zone to prevent oil and steam from entering the existing production well from the oil producing zone;

fracturing the underlying interval to establish fluid communication between the underlying interval and the oil producing zone;

completing the production well for production through the fractured portion of the underlying interval;

injecting steam through an injection well to increase the pressure in the oil producing zone and drive the oil and steam downward through the fractures to the production well in the underlying interval; and producing hydrocarbons and other fluids through the production well.

2. The method of claim 1, wherein the production well is completed with new perforations in the underlying interval about 10 to about 50 feet below the oil producing zone.

3. The method of claim 1, wherein the production well is completed with an underreamed gravel pack and slotted liner through the fractured portion of the underlying interval and the bottom one-half of the oil producing zone.

4. The method of claim 1, wherein the underlying interval has a permeability of about 0 md to about 50 md.

5. The method of claim 1, further comprising placing a pump at the bottom of the production well to aid in production.

6. The method of claim 1, further comprising injecting steam into the underlying interval through the newly completed production well to steam stimulate the well prior to producing through the newly completed production well.

7. A method of recovering oil from an existing production well bypassed by a steam override zone during a steamflood, which comprises:

drilling a production well below the oil producing zone into an underlying interval, said underlying interval having a permeability of about 0 md to about 50 md;

closing off the existing well perforations in the oil producing zone to prevent oil and steam from entering the production well from the oil producing zone;

fracturing the underlying interval to establish fluid communication between the underlying interval and the oil producing zone;

completing the production well for production through the fractured portion of the underlying interval, said completion comprising new perforations in the underlying interval about 10 to about 50 feet below the oil producing zone;

injecting steam through an injection well to increase the pressure in the oil producing zone and drive the oil and steam downward to the new perforations in the underlying interval; and producing hydrocarbons and other fluids through the production well.

* * * * *